US012668405B2

(12) United States Patent
Grabiec et al.

(10) Patent No.: US 12,668,405 B2
(45) Date of Patent: Jun. 30, 2026

(54) SWIVEL OPENING LID

(71) Applicant: Fellow Industries, Inc., San Francisco, CA (US)

(72) Inventors: Nicolette Grabiec, Chicago, IL (US); James Brannon Smith, San Francisco, CA (US); Julian Bagirov, Middletown, RI (US)

(73) Assignee: Fellow Industries, Inc., San Francisco, CA (US)

( * ) Notice: Subject to any disclaimer, the term of this patent is extended or adjusted under 35 U.S.C. 154(b) by 184 days.

(21) Appl. No.: 18/620,688

(22) Filed: Mar. 28, 2024

(65) Prior Publication Data

US 2025/0304338 A1 Oct. 2, 2025

(51) Int. Cl.
*B65D 47/26* (2006.01)

(52) U.S. Cl.
CPC .. *B65D 47/265* (2013.01); *B65D 2543/00046* (2013.01)

(58) Field of Classification Search
CPC .. B65D 47/265; B65D 47/266; B65D 47/261; B65D 47/26; B65D 2543/00046; B65D 2313/04; B65D 88/44
See application file for complete search history.

(56) References Cited

U.S. PATENT DOCUMENTS

2022/0015560 A1* 1/2022 Forsyth ..... B65D 51/1688
2022/0348387 A1* 11/2022 Ni ..... A47G 19/2272
2022/0354283 A1* 11/2022 Schneider ..... B65D 47/265
2023/0129354 A1* 4/2023 Gordon ..... B01F 33/5014 220/212.5
2024/0150090 A1* 5/2024 Adams ..... B65D 47/265

* cited by examiner

*Primary Examiner* — Javier A Pagan
(74) *Attorney, Agent, or Firm* — Cognition IP, P.C.; Edward Steakley; Justin White

(57) ABSTRACT

A container lid can include a stationary plate, swiveling component, and multiple position biasing components. The stationary plate can include a top surface, bottom surface, first outer circumference, longitudinal axis, and liquid opening therethrough. The swiveling component can be located proximate the stationary plate, can have a second outer circumference that is smaller than the first outer circumference, and can rotate about the longitudinal axis relative to the stationary plate to multiple discrete rotational positions that include at least one closed position where the swiveling component blocks the liquid opening and at least one open position where the swiveling component does not block the liquid opening. The multiple position biasing components can bias the swiveling component to stop its rotation and stay at one of the discrete rotational positions.

16 Claims, 14 Drawing Sheets

SWIVEL OPENING LID

TECHNICAL FIELD

The present disclosure relates generally to liquid containers, and more particularly to lids for beverage glasses and other liquid containers.

BACKGROUND

Beverage glasses and containers are ubiquitous, with users carrying their beverages in cups, glasses, water bottles, canteens, travel mugs, and the like. Many beverage containers and other liquid containers have lids of various types to limit or prevent spillage. For example, many portable coffee mugs utilize lids that allow users to drink coffee and other beverages with relative ease while they are on the go. Simpler lids can merely have small drinking openings, while others can include a mechanism that allows a drinking opening to be closed off.

Unfortunately, many such closing mechanisms can be cumbersome to operate, often requiring full attention of the user and the use of both hands. Furthermore, many such closing mechanisms have designs that are repetitive in nature and may not be aesthetically pleasing relative to the rest of the overall lid and liquid container. For example, simpler travel mug lids can have a sliding closing mechanism that can be operated with one hand while the other hand holds the travel mug. While these sliding closing mechanisms can be moved between open and closed positions, they can be cumbersome to operate, can be unpleasing aesthetically relative to the overall lid, and can even allow leakage while closed or have other usage issues.

Although traditional beverage and other liquid container lids have worked in the past, improvements are always helpful. In particular, what is desired are liquid container lids that have unique opening arrangements, that are easy to operate, and that are aesthetically pleasing.

SUMMARY

It is an advantage of the present disclosure to provide improved lids for liquid containers, which can include portable beverage containers such as travel mugs, wine glasses, other drinking glasses, and the like. The disclosed liquid container lids have unique opening arrangements, are easy to operate, and are aesthetically pleasing, among other improvements. These advantages can be accomplished at least in part by utilizing a swiveling component configured to rotate between multiple discrete open and closed positions, as well as position biasing components configured to bias the swiveling component to stop its rotation and stay at one of the discrete rotational positions.

In various embodiments of the present disclosure, an apparatus can include at least a stationary plate, a swiveling component, and multiple position biasing components. The stationary plate can have a top surface, a bottom surface, a first outer circumference, a longitudinal axis extending through the top and bottom surfaces, and a liquid opening offset from the longitudinal axis and extending through the top and bottom surfaces. The stationary plate can be configured to restrict the passage of liquid at its bottom surface from a separate liquid container. The swiveling component can be located proximate the stationary plate and an have a second outer circumference that is smaller than the first outer circumference. The swiveling component can be configured to rotate about the longitudinal axis relative to the stationary plate to multiple discrete rotational positions that include at least one closed position where the swiveling component blocks the liquid opening and at least one open position where the swiveling component does not block the liquid opening. The multiple position biasing components can be located at the stationary plate, the swiveling component, or both. The multiple position biasing components can be configured to bias the swiveling component to stop its rotation and stay at one of the discrete rotational positions.

In various detailed embodiments, the liquid can be a beverage, the separate liquid container can be a beverage container, and the apparatus can be configured to be a lid for the beverage container. The multiple discrete rotational positions can include one closed position and one open position that is rotated 180 degrees from the open position. The multiple discrete rotational positions can be about equal distances from each other. The swiveling component can include a protrusion offset from its center, with this protrusion being configured to extend into a recess in the stationary plate located at the longitudinal axis such that the swiveling component rotates about the protrusion and recess. In some arrangements, the protrusion can be coupled to the stationary plate by one or more mechanical features to keep the swiveling component and stationary plate together. In some arrangements, the swiveling component can be removably held against the stationary plate such that the swiveling component and protrusion can be readily pulled away from the stationary plate and recess with sufficient manual pulling force. In such embodiments, the swiveling component can include a protrusion magnetic component located at the protrusion and the stationary plate can include a recess magnetic component located at the recess. This protrusion magnetic component and this recess magnetic component can be configured to generate enough attractive magnetic force between them to keep the protrusion in the recess until the sufficient manual pulling force is applied.

In further detailed embodiments, at least a portion of the multiple position biasing components can be position biasing magnetic components. At least some of these position biasing magnetic components can be configured to generate enough attractive magnetic force to hold the swiveling component at any of the discrete rotational positions but not enough magnetic force to prevent manual pushing of the swiveling component away from any of the discrete rotational positions. Some of these position biasing magnetic components can include a rotating magnetic component located at the swiveling component and a stationary magnetic component located at the stationary plate for each of the multiple discrete rotational positions. The rotating magnetic component can be configured to interact with each of the stationary magnetic components separately as the rotating magnetic component rotates with the swiveling component to a discrete rotational position that corresponds to a stationary magnetic component. Some or all of the multiple position biasing components can be embedded within and remain stationary with respect to the stationary plate, the swiveling component, or both. In some embodiments, the stationary plate can include a sealing component located around its first outer circumference, which sealing component can be configured to form a seal against the separate liquid container when the apparatus is installed to the separate liquid container. The apparatus can also include the separate liquid container in some arrangements.

In various further embodiments of the present disclosure, a swivel opening lid configured for use with a separate portable beverage container can include a stationary plate, a swiveling component, a recess magnetic component, a protrusion magnetic component, a rotating magnetic component, and multiple stationary magnetic components. The stationary plate can have a top surface, a bottom surface, a first outer circumference, a longitudinal axis extending through the top and bottom surfaces, a recess in the top surface at the longitudinal axis, and a beverage opening offset from the longitudinal axis and extending through the top and bottom surfaces. The stationary plate can be configured to restrict the passage of a beverage from the separate portable beverage container at its bottom surface. The swiveling component can be located atop the stationary plate and can have a protrusion that extends into the recess and a second outer circumference that is smaller than the first outer circumference. The swiveling component can be configured to rotate about the longitudinal axis relative to the stationary plate to multiple discrete rotational positions that include at least one closed position where the swiveling component blocks the beverage opening and at least one open position where the swiveling component does not block the beverage opening. The recess magnetic component can be located at the stationary plate recess, and the protrusion magnetic component can be located at the swiveling component protrusion. The protrusion magnetic component and recess magnetic component can be configured to generate enough attractive magnetic force between them to keep the protrusion in the recess until a sufficient manual pulling force is applied to pull them apart. The rotating magnetic component can be located at the swiveling component, and the multiple stationary magnetic components can be located at the stationary plate. The rotating magnetic component can be configured to interact with each of the multiple stationary magnetic components separately as the rotating magnetic component rotates with the swiveling component to a discrete rotational position that corresponds to a stationary magnetic component.

In various detailed embodiments, the rotating magnetic component can be configured to interact with each of the multiple stationary magnetic components to bias the swiveling component to stop its rotation and stay at one of the discrete rotational positions. The multiple discrete rotational positions can include one closed position and one open position located at 180 degrees with respect to the closed position. In some arrangements, the swivel opening lid can include a sealing component located around the first outer circumference of the stationary plate. This sealing component can be configured to facilitate the ready installation and removal of the swivel opening lid from the separate portable beverage container, and can also be configured to from a press-fit seal against the separate portable beverage container when the swivel opening lid is installed to the separate portable beverage container.

In still further embodiments of the present disclosure, a portable beverage container can include a main reservoir configured to hold a beverage or other liquid therein and a swivel opening lid removably coupled to the main reservoir. The swivel opening lid can include a stationary plate, a swiveling component, and multiple position biasing components. Similar to foregoing embodiments, the stationary plate can have a top surface, a bottom surface, a first outer circumference, a longitudinal axis extending through the top and bottom surfaces, and a beverage opening offset from the longitudinal axis and extending through the top and bottom surfaces. The stationary plate can be configured to restrict the passage of a beverage from the main reservoir at its bottom surface. The swiveling component can be located proximate the stationary plate and can have a second outer circumference that is smaller than the first outer circumference. The swiveling component can be configured to rotate about the longitudinal axis relative to the stationary plate to multiple discrete rotational positions that include at least one closed position where the swiveling component blocks the beverage opening and at least one open position where the swiveling component does not block the beverage opening. The multiple position biasing components can be located at the stationary plate, the swiveling component, or both, and these multiple position biasing components can be configured to bias the swiveling component to stop its rotation and stay at one of the discrete rotational positions.

In various detailed embodiments, these components can have some or all of the foregoing features from the previous embodiments in any combination. For example, the stationary plate can include a recess in its top surface, a recess magnetic component at the recess, and/or multiple stationary magnetic components as part of the multiple position biasing components. Also, the swiveling component can include a protrusion configured to extend into the recess, a protrusion magnetic component located at the protrusion, and/or a rotating magnetic component as one of the multiple position biasing components. The protrusion magnetic component can be configured to interact with the recess magnetic component to hold the swiveling component against the stationary plate. The rotating magnetic component can be configured to interact with each of the multiple stationary magnetic components to hold the swiveling component at one of the discrete rotational positions.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures and arrangements for the disclosed systems, apparatuses, features, and methods for swivel opening lids and associated liquid containers. These drawings in no way limit any changes in form and detail that may be made to the disclosure by one skilled in the art without departing from the spirit and scope of the disclosure.

DETAILED DESCRIPTION

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to systems, apparatuses, and features for high-quality lids for beverage containers and other liquid containers. In particular, the disclosed liquid container lids have unique opening arrangements, are easy to operate, and are aesthetically pleasing, among other benefits. In various embodiments, the disclosed swivel opening lids include a stationary component with a liquid opening and a swiveling component configured to rotate between multiple discrete open and closed positions with respect to the stationary component. The disclosed swivel opening lids can also include position biasing components configured to bias the swiveling component to stop its rotation and stay at one of the "held" discrete rotational positions.

Although the various embodiments disclosed herein focus on lids for beverage containers, such as wine glasses, drinking glasses, portable coffee mugs, and the like for purposes of simplicity in illustration, it will be readily appreciated that the disclosed systems, apparatuses, and features can similarly be used for any other kind of liquid container. For example, the disclosed systems, apparatuses and features can be used for watering cans, fuel dispensers, and any other form of fluid holding device. Furthermore, it will be understood that reference to magnetic components herein can include actual magnets, metal components suitable for interaction with magnets, or any combination thereof. For example, two interacting magnetic components can be two actual magnets, or they can be one magnet and any metal component suitable for interacting with that magnet. Other examples, possibilities, and extrapolations of the various embodiments, components, and features disclosed herein will be readily understood by those of skill in the art.

Figure 1:
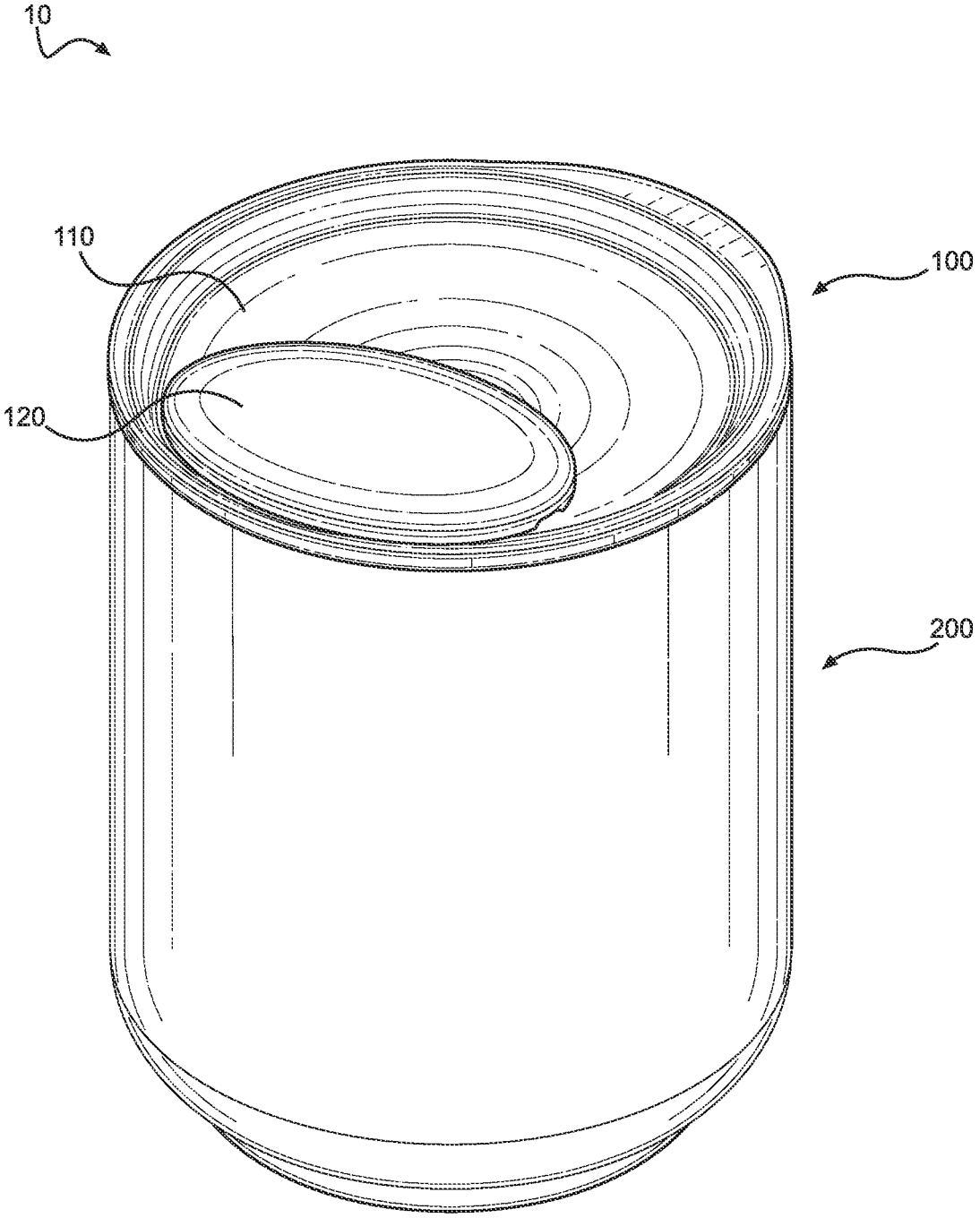
FIG. 1 illustrates in front perspective view an example liquid container with a swivel opening lid in a closed configuration according to one embodiment of the present disclosure.

Referring first to FIG. 1, an example liquid container with a swivel opening lid in a closed configuration is shown in front perspective view. Liquid container 10 can be used as a beverage container in various embodiments, such as a tumbler or wine glass, for example. Liquid container 10 can include a lid 100 and a main reservoir 200 configured to hold a beverage or other liquid therein. Such a beverage can be water, coffee, soda, wine, or any other suitable beverage or liquid as may be desired by a user. In various embodiments, lid 100 can be removably coupled to main reservoir 200 in a manner that provides a liquid seal between these items, such as by way of a suitable threaded arrangement or a simple press-fit involving one or more compressible O-rings or other suitable sealing items around the outer side circumference of the lid. Other removable sealable coupling arrangements are also possible. Both lid 100 and main reservoir 200 can be reusable and can be easily cleaned when separated from each other.

Lid 100 can be referred to as a "swivel opening" lid and can have various components and features to facilitate smooth and aesthetically pleasing opening and closing operations. In some arrangements, swivel opening lid 100 can include a stationary plate 110 and a proximately located swiveling component 120 that can be rotated about the stationary plate to multiple different discrete held rotational positions including at least one open position and at least one closed position. Swiveling component 120 can be called a "pebble," although other names and nomenclature can be used for this and other device components. As shown in FIG. 1, swiveling component or pebble 120 is at a closed position with respect to stationary plate 110 of swivel opening lid 100.

Figure 2:
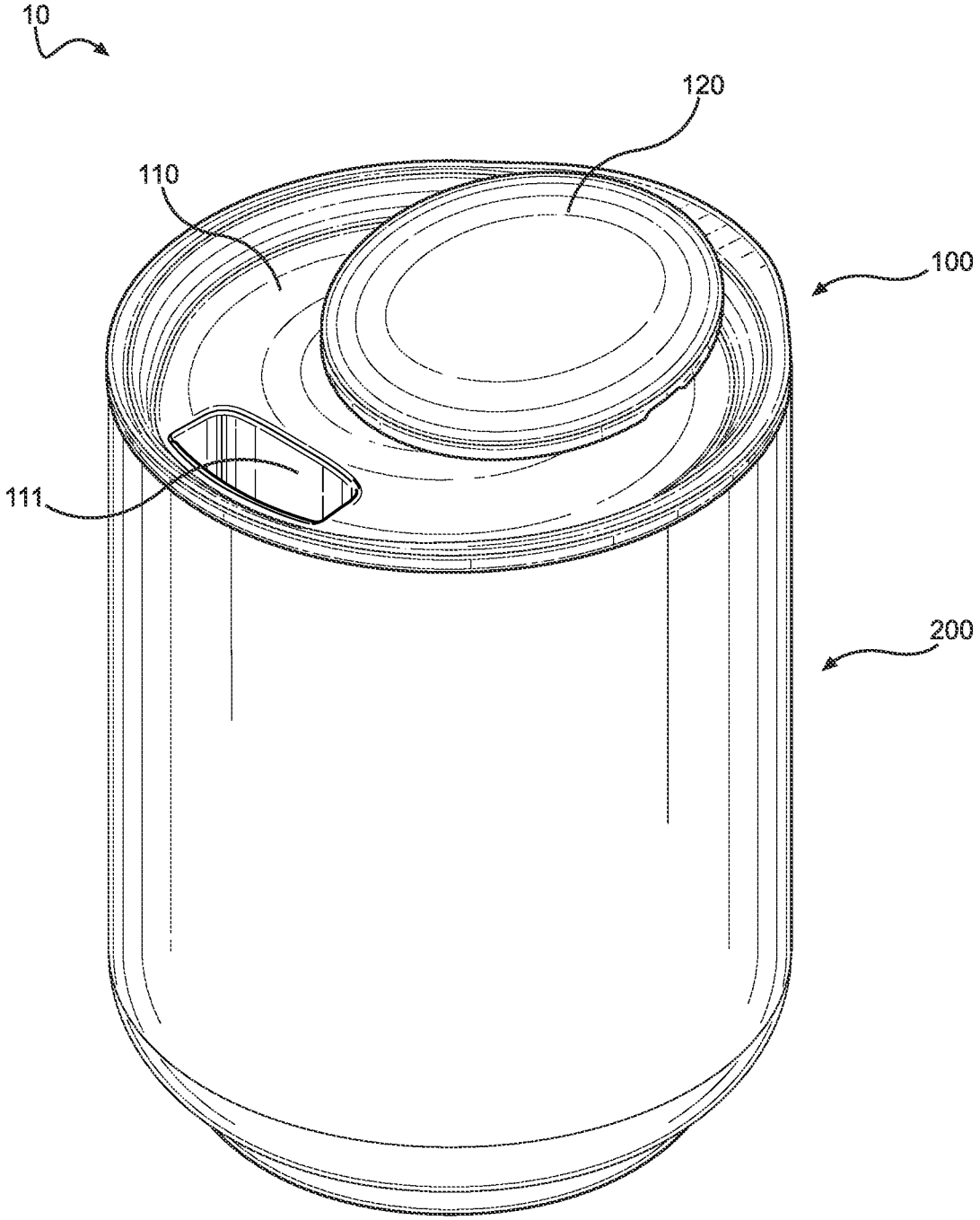
FIG. 2 illustrates in front perspective view the liquid container of FIG. 1 with its lid in an open configuration according to one embodiment of the present disclosure.

Continuing with FIG. 2, the liquid container of FIG. 1 is shown in front perspective view with its lid in an open configuration. Again, liquid container 10 can have a swivel opening lid 100 and a main reservoir 200, which on its own can form an open drinking cup, glass, or other beverage container, for example. As shown in FIG. 2, swiveling component or pebble 120 has been rotated or swiveled 180 degrees to be at an open position with respect to stationary plate 110 of swivel opening lid 100. This rotational repositioning of swiveling component 120 can result in exposing liquid opening 111 such that liquid can pass from main reservoir 200 through this liquid opening and out of liquid container 10. Liquid opening 111 can also be referred to as a beverage opening or drinking opening for beverage container use.

In various embodiments, swiveling component 120 can be rotated or swiveled relative to stationary plate 110 and main reservoir 200 while these items remain stationary. Swiveling component 120 can also be held at one of multiple discrete rotational positions that can include the specific closed and open positions shown in FIGS. 1 and 2. This can be accomplished by way of one or more position biasing components, which can be located at stationary plate 110, at the swiveling component 120, or both. Such position biasing components can be configured to bias swiveling component 120 to stop its rotation and stay at one of the discrete rotational positions relative to stationary plate 110, details for which are provided below.

Figure 3:
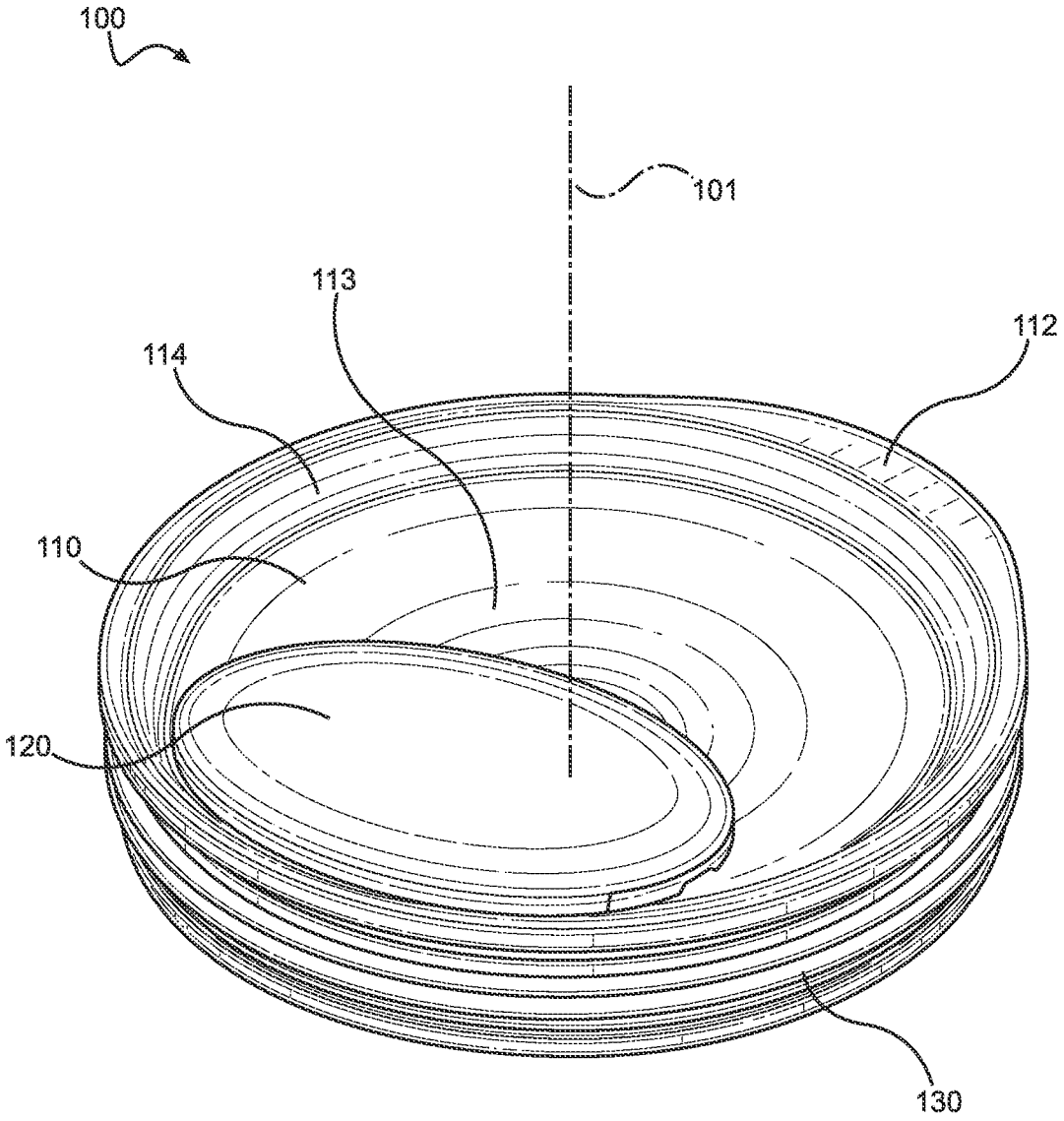
FIG. 3 illustrates in front perspective view an example swivel opening lid according to one embodiment of the present disclosure.

Turning next to FIG. 3, an example swivel opening lid in isolation is illustrated in front perspective view. Again, swivel opening lid 100 can be removably coupled to a drinking glass, beverage container, main reservoir, or other liquid container such that this lid can readily appear alone as shown in FIG. 3. Swiveling component 120 can be removably coupled to or otherwise located at a top surface of stationary plate 110 such that the swiveling component can swivel or rotate around the top surface about a longitudinal axis 101 that extends through the stationary plate and swiveling component. As shown in FIG. 3, swiveling component 120 is at a closed rotational position that is blocking or covering a liquid opening in stationary plate 110 such that swivel opening lid 100 is in a closed configuration (i.e., as also shown in FIG. 1). The liquid opening can be offset from longitudinal axis 101 such that rotation or swiveling of swiveling component 120 about the axis can result in blocking or unblocking the liquid opening.

It will be readily appreciated that swiveling component 120 can prevent or restrict the passage of liquid through the liquid opening (shown in FIG. 2) when the swiveling component is in the closed rotational position shown, and that a bottom surface of stationary plate 110 can prevent or restrict the passage of liquid through the stationary plate at any time. One or more sealing components 130 can be located around an outer circumference of stationary plate 110 along its side(s). Such sealing component(s) 130 can be one or more rubber or silicone O-rings, gaskets, or other suitable items that can form a seal between swivel opening lid 100 and an associated beverage or liquid container when the lid is removably installed thereto. In some arrangements, one or more flanges 112 can extend outward from an upper edge of stationary plate 110, and these can help to facilitate the ready installation and removal of swivel opening lid 100 to and from the associated beverage or liquid container as will be readily appreciated.

As shown, stationary plate 110 can have a first outer circumference and swiveling component 120 can have a second outer circumference that is smaller such that the swiveling component can remain within the larger first outer circumference of the stationary plate as the swiveling component rotates or swivels to its different rotational positions. Stationary plate 110 can have various features to facilitate this rotational activity within its outer circumference. For example, the top surface of stationary plate 110 can have a central region 113 that is bowl shaped and one or more outer edges 114 that are raised such that the swiveling component 120 is kept at the central region within the raised outer edge(s) while it rotates between or is held at any of its discrete rotational positions. In some embodiments, swiveling component 120 of swivel opening lid 100 can have just two discrete rotational positions at which it is held, which positions can correspond to the open and closed positions shown in FIGS. 1 and 2 above.

FIGS. 4A-4D illustrate in top plan views an example swivel opening lid in closed, first open, second open, and third open configurations respectively. In various embodiments, some or all of the configurations shown can represent different held discrete rotational positions of swiveling component 120 with respect to stationary plate 110. For example, one embodiment of a swivel opening lid can include held discrete rotational positions of the swiveling component 120 that include just one closed configuration (e.g., FIG. 4A) and just one open configuration (e.g., FIG. 4C), for a total of two discrete rotational positions where the swiveling component is held in place or otherwise biased toward that rotational position. Other embodiments of a swivel opening lid are also possible where more than two discrete rotational positions of the pebble or swiveling component 120 are possible, such as multiple discrete open positions.

As shown in the views of FIGS. 4A-4D, stationary plate 110 can remain in place while swiveling component 120 can rotate or swivel to any of the illustrated rotational positions. Rotation can be about a longitudinal axis located at or near the center of stationary plate 110 and perpendicular to the page, as noted above. Rotation can be clockwise or counterclockwise and can proceed freely in either direction through any number of revolutions. In various embodiments, movement or rotation of swiveling component or pebble 120 can be accomplished by manually pushing or flicking the pebble from one position to or through another position, such as by a thumb or finger of a user, for example.

Figure 4A:
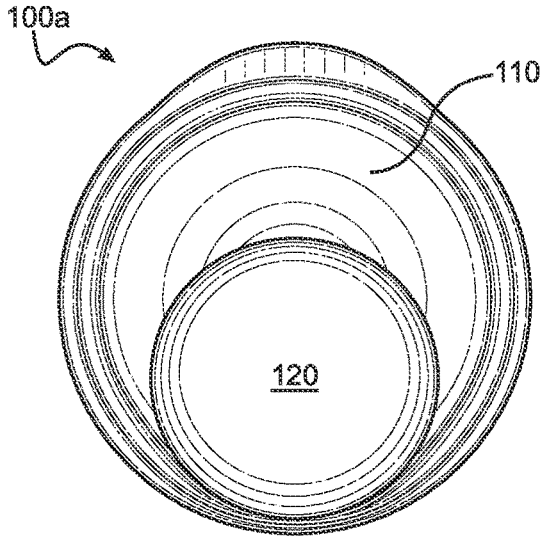
FIG. 4A illustrates in top plan view an example swivel opening lid in a closed configuration according to one embodiment of the present disclosure.
Figure 4B:
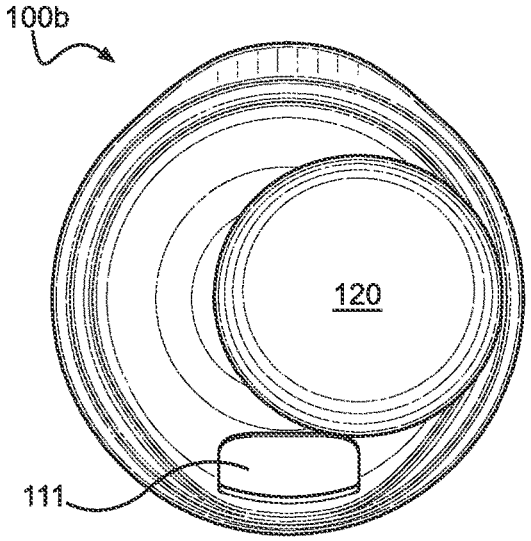
FIG. 4B illustrates in top plan view the swivel opening lid of FIG. 4A in a first open configuration according to one embodiment of the present disclosure.
Figure 4C:
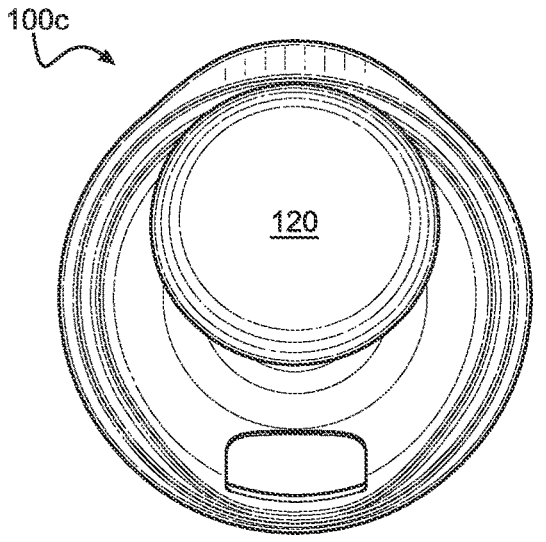
FIG. 4C illustrates in top plan view the swivel opening lid of FIG. 4A in a second open configuration according to one embodiment of the present disclosure.
Figure 4D:
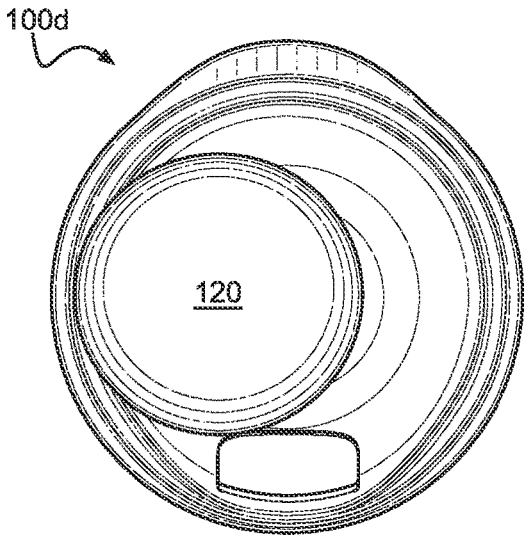
FIG. 4D illustrates in top plan view the swivel opening lid of FIG. 4A in a third open configuration according to one embodiment of the present disclosure.

Starting with FIG. 4A, closed configuration 100*a* reflects a swivel opening lid with its swiveling component 120 rotated or set with respect to its stationary plate 110 such that its liquid opening is blocked or covered. This can be identical or substantially similar to the configuration shown in FIG. 1 above. Moving next to FIG. 4B, first open configuration 100*b* reflects the same swivel opening lid with its swiveling component 120 rotated 90 degrees counterclockwise such that liquid opening 111 is not blocked. Continuing with FIG. 4C, second open configuration 100*c* shows the swivel opening lid with swiveling component 120 rotated another 90 degrees counterclockwise (180 degrees total) such that the liquid opening remains unblocked. This can be identical or substantially similar to the configuration shown in FIG. 2 above. Lastly with FIG. 4D, third open configuration 100*d* shows the swivel opening lid with swiveling component 120 rotated yet another 90 degrees counterclockwise (270 degrees total) such that the liquid opening remains unblocked. While four specific configurations are shown here, it will be readily appreciated that more or fewer configurations may be possible for a given swivel opening lid.

In some embodiments, only configurations 100*a* and 100*c* can represent discrete rotational positions where pebble or swiveling component 120 is biased or held in place, such as by position biasing components, while configurations 100*b* and 100*d* can represent rotational positions where the pebble can rotate or move through that position, for a total of two discrete rotational positions. In other embodiments, each of configurations 100*a*, 100*b*, 100*c*, and 100*d* can represent discrete rotational positions where the pebble can be biased or held in place, for a total of four discrete rotational positions. More or fewer discrete rotational positions may be possible for a given swivel opening lid.

As noted above, swiveling component 120 can be held or biased to stay at one of multiple discrete rotational positions by way of one or more position biasing components, one or more of which can be present of each discrete rotational position. Such position biasing components can include mechanical features such as protrusions, ridges, grooves, indents, latches, and the like. In some arrangements, position biasing components can include magnetic components configured to interact to hold or bias swiveling component 120 at a discrete rotational position. For example, at least one magnetic component can be located at or within swiveling component 120 and one or more corresponding magnetic components can be located at or within stationary plate 110 at one or more locations that result in multiple discrete rotational positions for the swiveling component due to magnetic interactions. Examples with further details are provided below.

In some arrangements, interacting magnetic components can also be used to removably couple swiveling component 120 to stationary plate 110. For example, one of swiveling component 120 or stationary plate 110 can have a protrusion with a magnetic component while the other can have a recess with a corresponding magnetic component. The protrusion can then fit into the recess and the magnetic components can generate sufficient magnetic attraction force to keep the swiveling component and stationary plate held together by default and during rotation of the swiveling component. The longitudinal axis (i.e. axis of rotation) can extend through the mating protrusion and recess in such arrangements. This can result in a removable coupling in that the swiveling component can be readily pulled away from the stationary plate with sufficient manual pulling force.

Figure 5A:
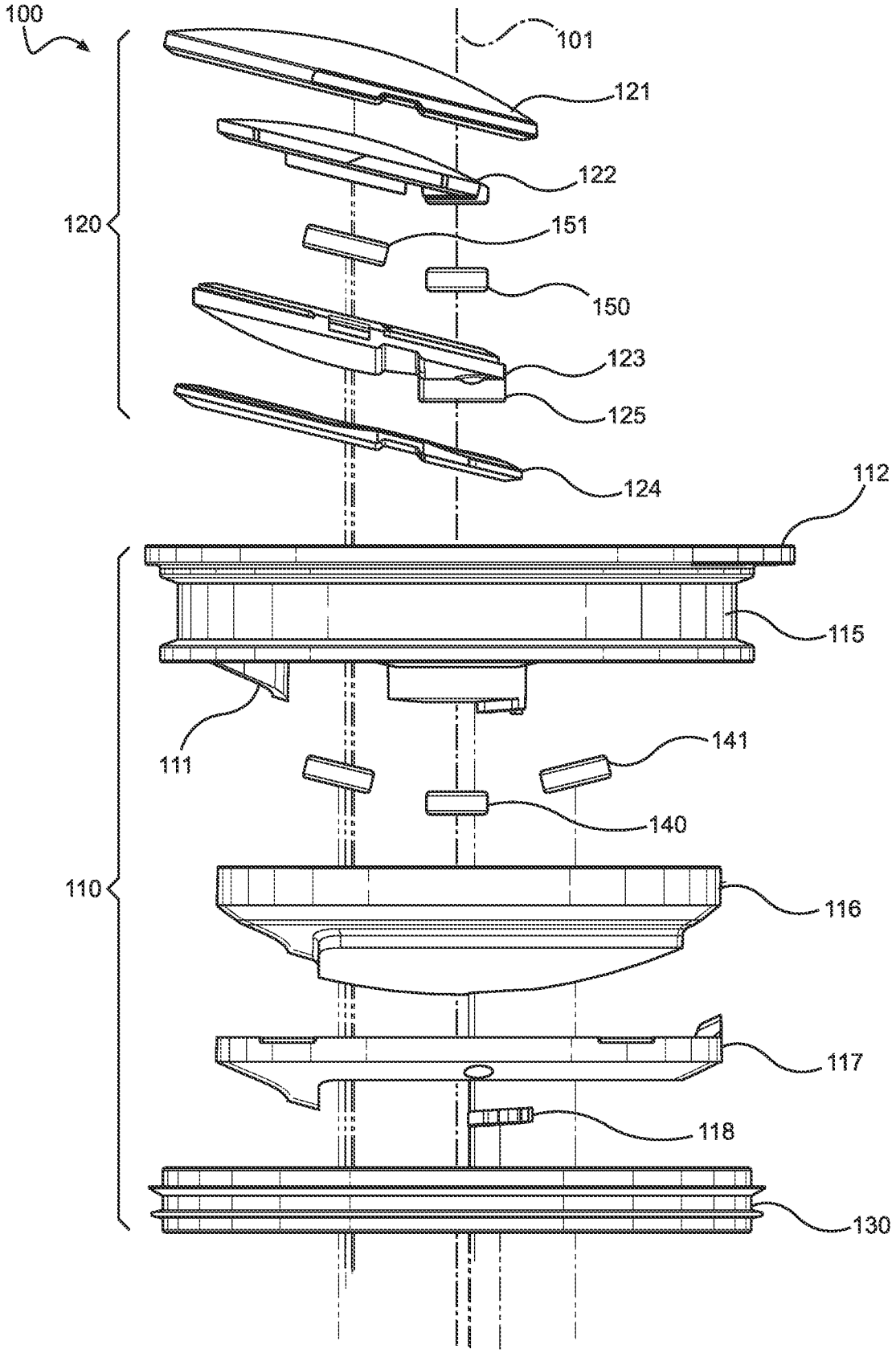
FIG. 5A illustrates in side elevation exploded view an example swivel opening lid according to one embodiment of the present disclosure.
Figure 5B:
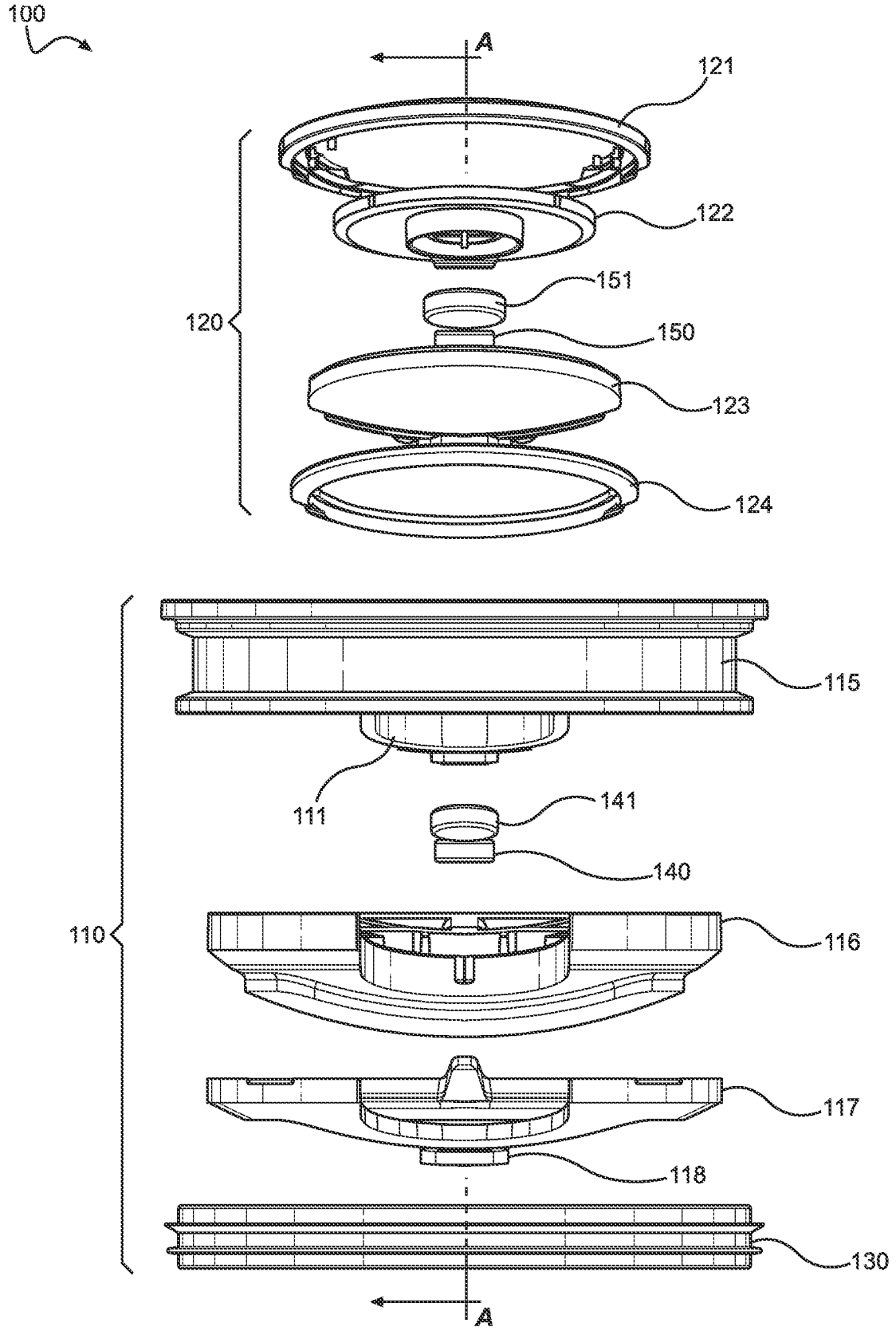
FIG. 5B illustrates in front elevation exploded view the swivel opening lid of FIG. 5A according to one embodiment of the present disclosure.

Transitioning now to FIGS. 5A and 5B, an example swivel opening lid is illustrated in side elevation exploded and front elevation exploded views respectively. These views depict various parts of swivel opening lid 100 in a closed configuration with swiveling component 120 being rotated to a closed position such that it blocks a liquid opening 111 in stationary plate 110. As shown, stationary plate 110 can include upper portion 115, middle portion 116, and lower portion 117 as separate parts that can be put together by way of mating features in each portion and then held in place by way of fastening component 118. Each of upper portion 115, middle portion 116, and lower portion 117 can be integrally formed parts, such as by injection molding, for example. Upper portion 115 can include various stationary plate features noted above such as flange 112 and liquid opening 111, which can form a downward projecting spout. Sealing component 130 can be a flexible seal that can be installed onto and removed from an outer sidewall of upper portion 115. Sealing component 130 can be a separate item or can be considered as a part of stationary plate 110 in some arrangements.

Swiveling component 120 can include outer cap 121, upper internal housing 122, and lower internal housing 123 as separate parts that can be put together by way of mating features in each item and then held in place by way of fastening ring 124. Each of outer cap 121, upper internal housing 122, lower internal housing 123, and fastening ring 124 can be integrally formed parts, such as by injection molding, for example. Lower internal housing 123 can have a downward extending protrusion 125 that is offset from its center and from the center of the overall swiveling component 120. Protrusion 125 can be configured to extend into a recess in the top surface of stationary plate 110 (shown below). Again, swiveling component 120 can rotate relative to stationary plate 110 about longitudinal axis 101, which can extend through protrusion 125 and the recess in the top surface of the stationary plate.

A rotational coupling between stationary plate 110 and swiveling component 120 can be facilitated by way of protrusion 125 extending into the stationary plate recess, as shown in further figures below. Stationary plate 110 and swiveling component 120 can be held together for the rotational coupling by way of recess magnetic component 140 located in the stationary plate and protrusion magnetic component 150 located in the swiveling component. In particular, recess magnetic component 140 can be located in a cavity formed in upper portion 115 of stationary plate 110 that is directly beneath the recess (which is also in the upper portion), while protrusion magnetic component 150 can be located within protrusion 125. This can position recess magnetic component 140 and protrusion magnetic component 150 next to each other when protrusion 125 is inserted into the recess in stationary plate, and these two magnetic components can be configured to generate enough attractive magnetic force between them to keep the protrusion in the recess until the sufficient manual pulling force is applied.

Similar magnetic component interactions can be implemented to facilitate biasing of swiveling component 120 to one of its discrete rotational positions, such that at least a portion of the noted multiple position biasing components can be position biasing magnetic components. These position biasing magnetic components can be configured to generate enough attractive magnetic force to hold swiveling component 120 at any of its discrete rotational positions but not enough magnetic force to prevent manual pushing of the swiveling component away from any of the discrete rotational positions. To this end, rotating magnetic component 151 can be located at swiveling component 120, and a stationary magnetic component 141 can be located at stationary plate 110 for some or all of the multiple discrete rotational positions. In a specific embodiment, rotating magnetic component 151 can be held in a specific recess formed between upper internal housing 122 and lower internal housing 123 of swiveling component 120, while each stationary magnetic component 141 can be located within a specific cavity in middle portion 116 of stationary plate 110. Other arrangements and magnetic component locations are possible, as will be readily appreciated.

Figure 6A:
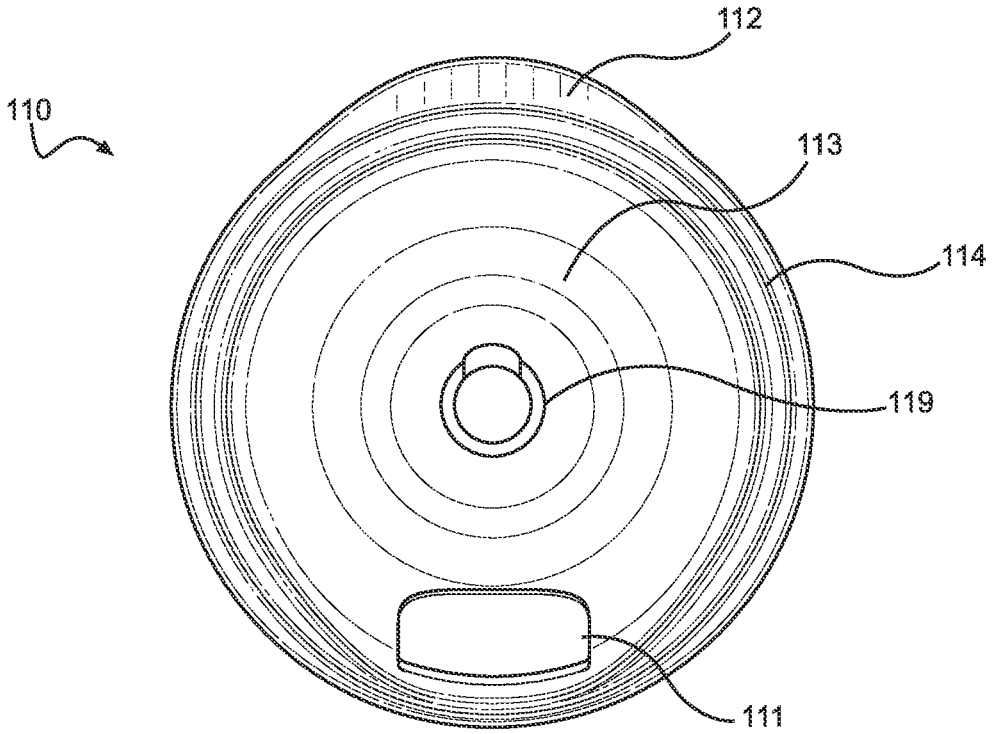
FIG. 6A illustrates in top plan view an example stationary plate for a swivel opening lid according to one embodiment of the present disclosure.
Figure 6B:
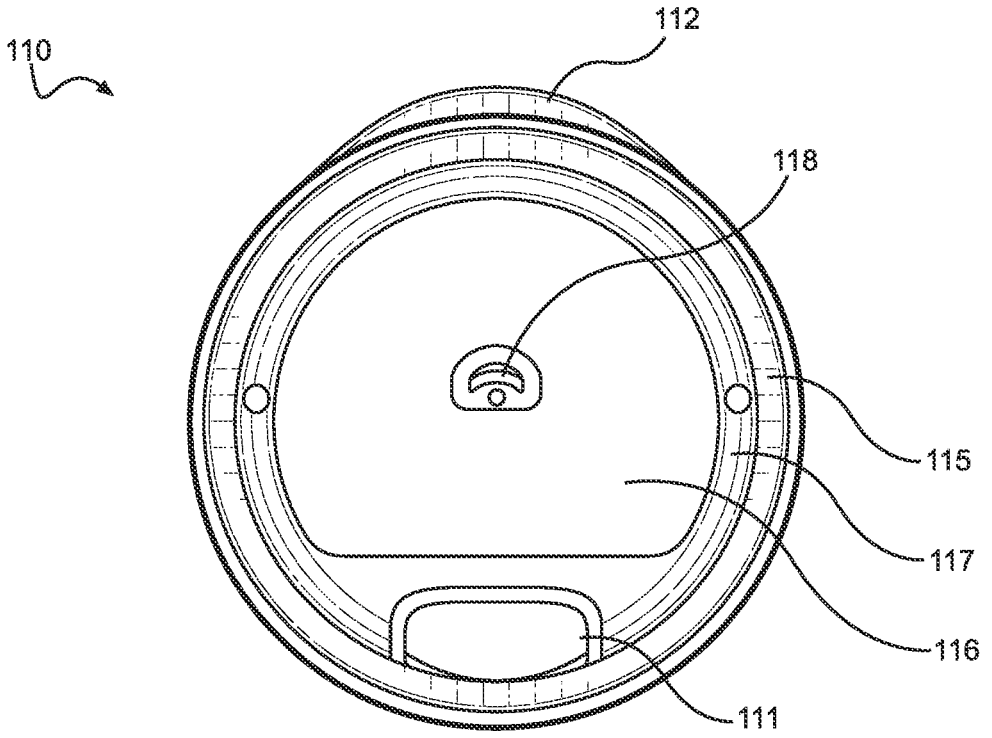
FIG. 6B illustrates in bottom plan view the stationary plate of FIG. 6A according to one embodiment of the present disclosure.
Figure 6C:
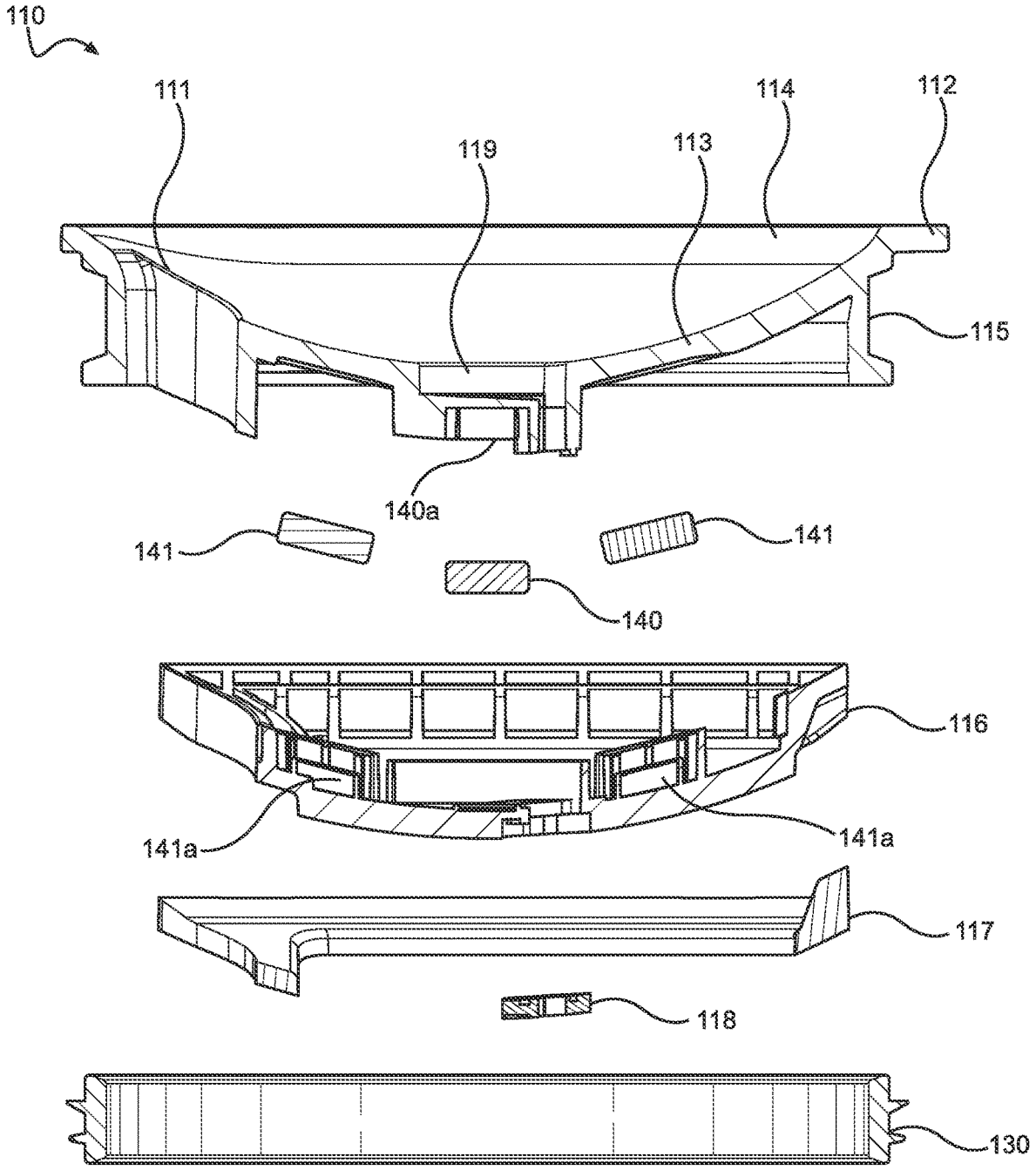
FIG. 6C illustrates in side elevation exploded cross-section view the stationary plate of FIG. 6A according to one embodiment of the present disclosure.

Moving now to FIGS. 6A-6C, an example stationary plate for a swivel opening lid is shown in top plan, bottom plan, and side elevation exploded cross-section views respectively. As noted above, stationary plate 110 can include liquid opening 111, one or more flanges 112, a bowl shaped central region 113, and one or more raised outer edges 114, among other features. Stationary plate 110 can also include a recess 119 in the middle of central region 113, with this recess 119 being sized and shaped to accept a protrusion that extends downward from a swiveling component of the swivel opening lid. Each of these features can be located on upper portion 115 of stationary plate 110, which upper portion can be a distinct part that can be assembled with middle portion 116 and lower portion 117 as other distinct parts that are all held in place by way of fastening component 118 to form the entire stationary plate.

The exploded cross-section view of FIG. 6C is taken along line A-A of FIG. 5B, and this view provides further perspective for many of the various parts and features of stationary plate 110 set forth above. In addition to the foregoing items, recess magnetic component 140 can be located in cavity 140*a* formed in upper portion 115 of stationary plate 110. This recess magnetic component cavity 140*a* can be located directly beneath recess 119 as shown. Also, each stationary magnetic component 141 can be located within its own cavity 141*a* in middle portion 116 of stationary plate 110. Each of these stationary magnetic component cavities 141*a* can be positioned so that they will be directly beneath the rotating magnetic component as the swiveling component passes thereabove. This can then result in each stationary magnetic component 141 within its respective cavity interacting with the rotating magnetic component to hold it and the swiveling component in place at a discrete rotational position that corresponds to the stationary magnetic component.

Figure 7A:
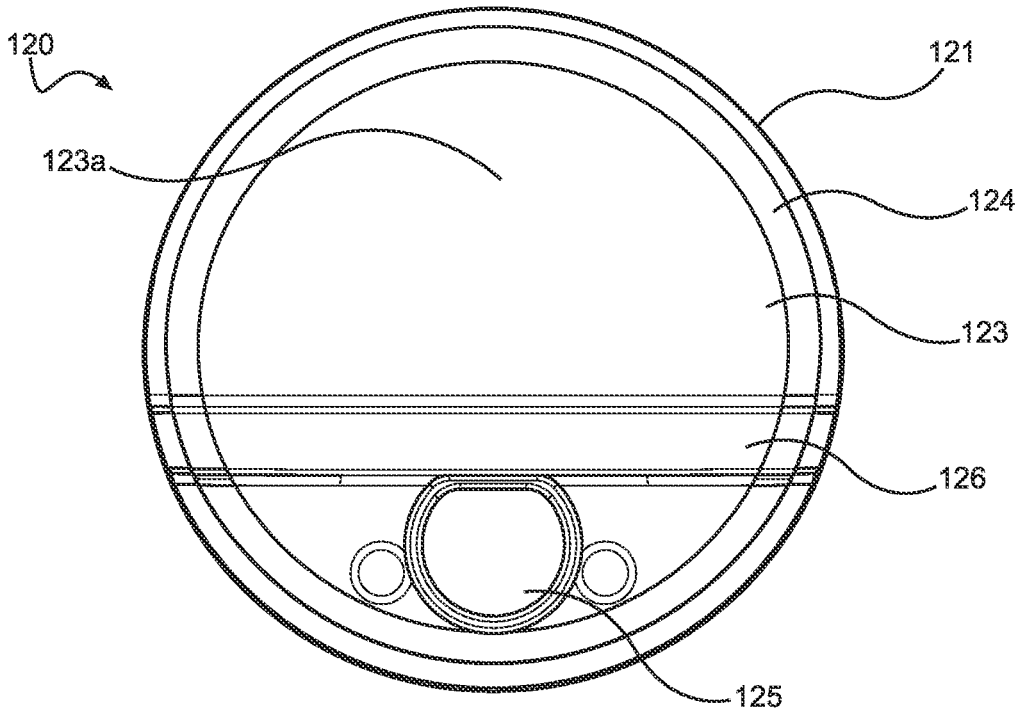
FIG. 7A illustrates in bottom plan view an example swiveling component for a swivel opening lid according to one embodiment of the present disclosure.
Figure 7B:
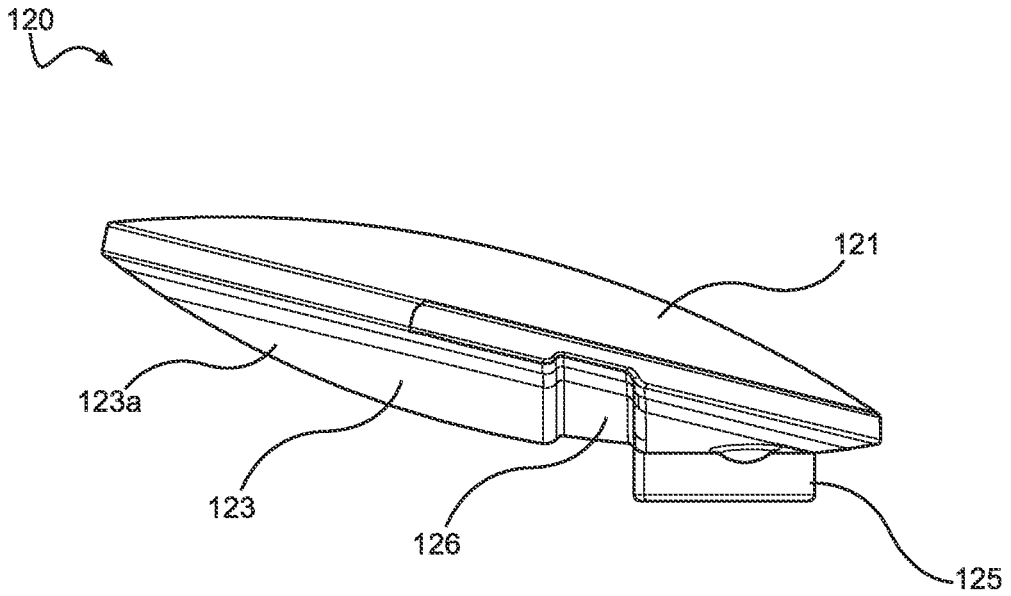
FIG. 7B illustrates in side elevation view the swiveling component of FIG. 7A according to one embodiment of the present disclosure.
Figure 7C:
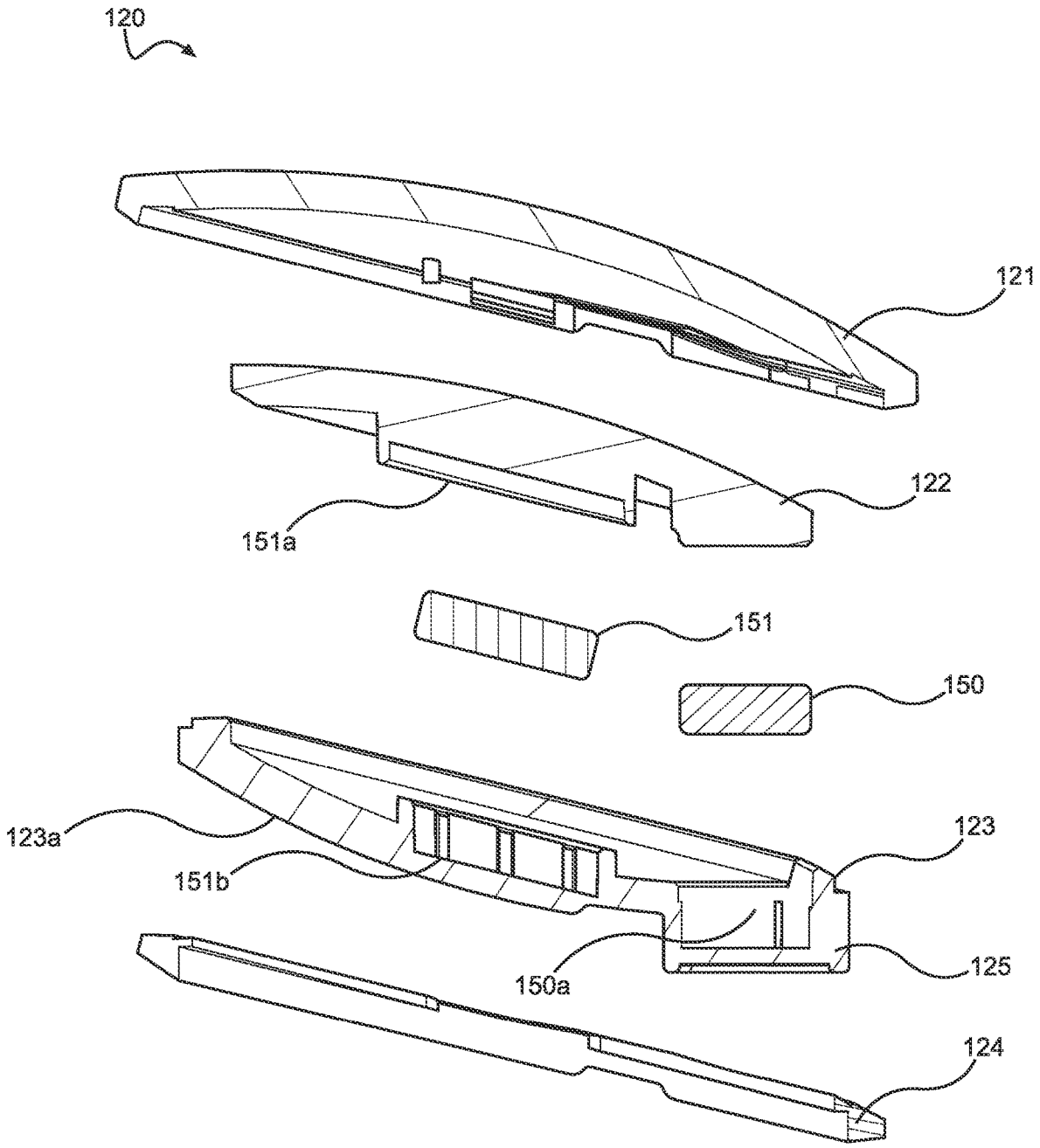
FIG. 7C illustrates in side elevation exploded cross-section view the swiveling component of FIG. 7A according to one embodiment of the present disclosure.

Continuing with FIGS. 7A-7C, an example swiveling component for a swivel opening lid is shown in bottom plan, side elevation, and side elevation exploded cross-section views respectively. As noted above, swiveling component 120 can include outer cap 121, upper internal housing 122, lower internal housing 123, fastening ring 124, and protrusion 125, among other parts and features. Swiveling component 120 can also include a slot 126 along its bottom from one side to the other, which slot can facilitate airflow for a smoother rotational motion. A bottom surface region 123*a* of lower internal housing 123 can be sized and shaped to facilitate the firm blocking of the liquid opening in the stationary plate when the bottom surface region is located above the liquid opening.

The exploded cross-section view of FIG. 7C is also taken along line A-A of FIG. 5B, and this view provides further perspective for many of the various parts and features of stationary plate 110 set forth above. In addition to the foregoing items, protrusion magnetic component 150 can be located in cavity 150*a* formed in the protrusion 150 itself. This protrusion magnetic component cavity 150*a* can be formed such that protrusion magnetic component 150 is located directly above the recess in the stationary plate when protrusion 125 is inserted into the recess. Also, rotating magnetic component 151 can be located within partial cavity 151*a* in upper internal housing 122 and also within partial cavity 151*b* in lower internal housing 123, which partial cavities can combine to enclose the rotating magnetic component when the upper and lower internal housings are assembled together. The partial rotating magnetic component cavities 151*a*, 151*b* can be positioned so that they will be directly above each of the stationary magnetic components in the stationary plate when the swiveling component passes above them. This can then result in rotating magnetic component 151 interacting with any given stationary magnetic component to hold it and the swiveling component in place at a discrete rotational position that corresponds to the stationary magnetic component.

Figure 8A:
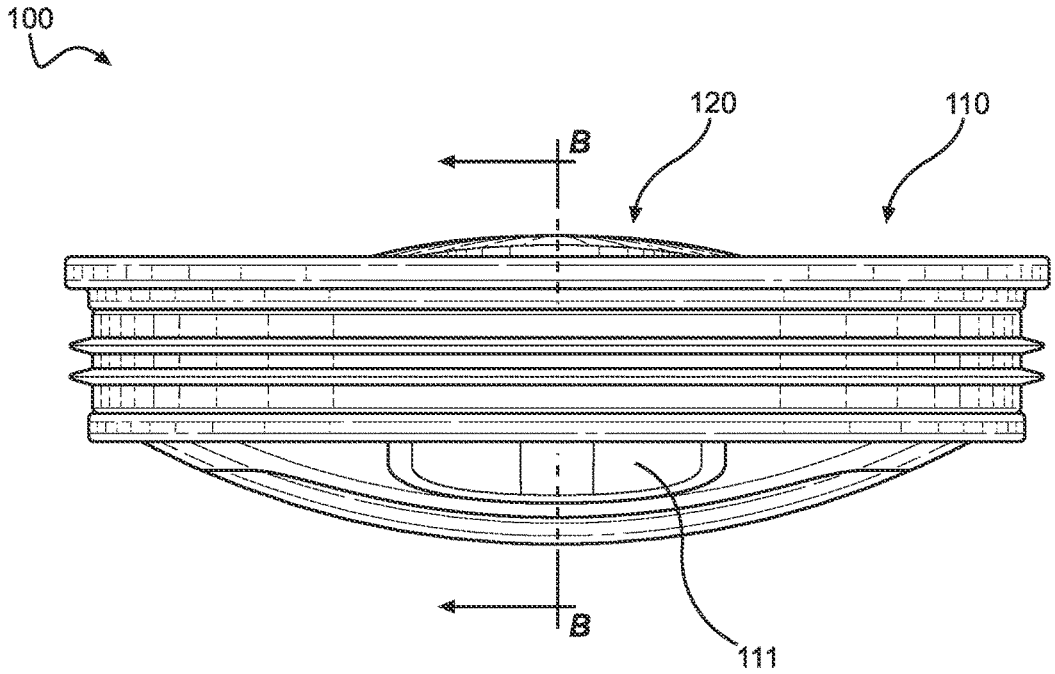
FIG. 8A illustrates in front elevation view an example swivel opening lid according to one embodiment of the present disclosure.
Figure 8B:
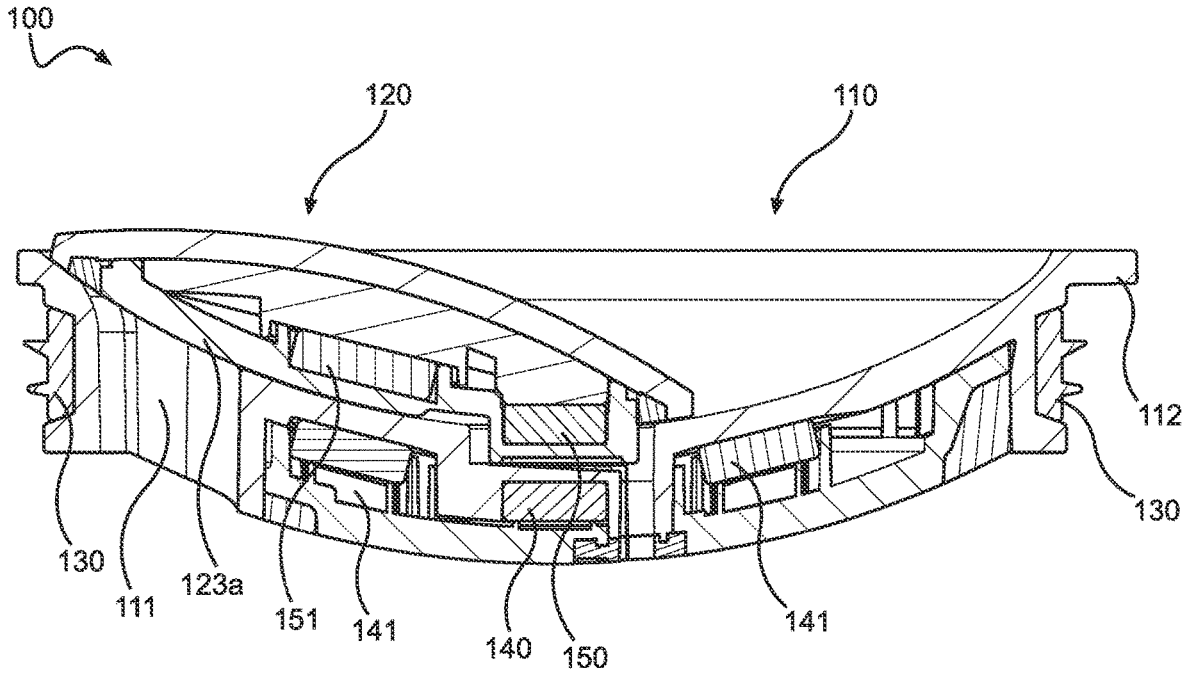
FIG. 8B illustrates in side elevation cross-section view the swivel opening lid of FIG. 8A according to one embodiment of the present disclosure.
Figure 9A:
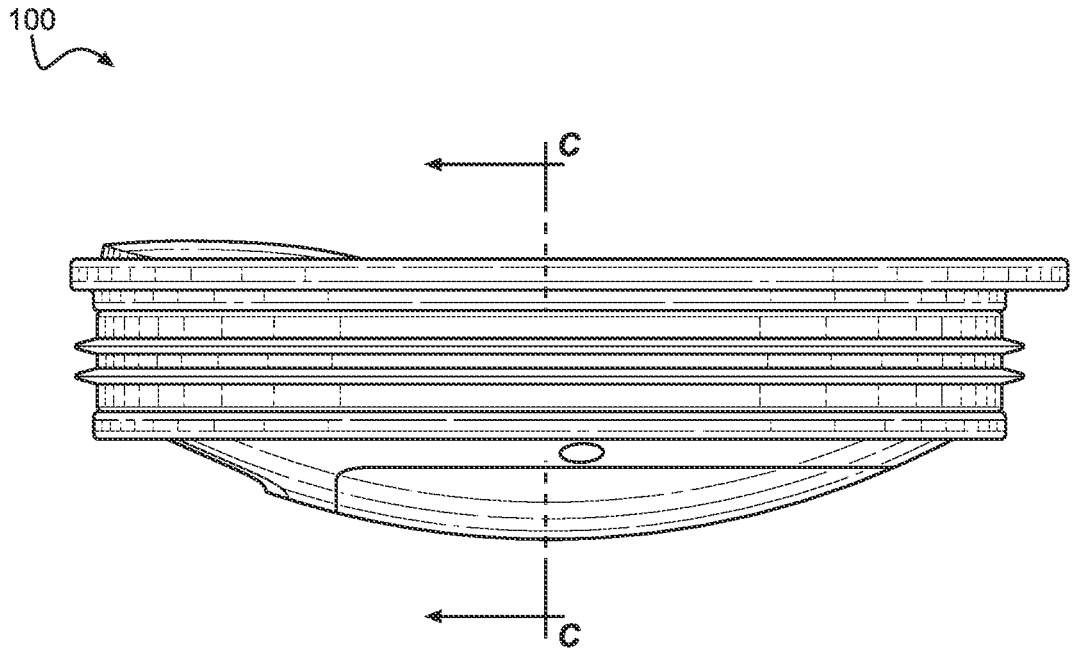
FIG. 9A illustrates in side elevation view an example swivel opening lid according to one embodiment of the present disclosure.
Figure 9B:
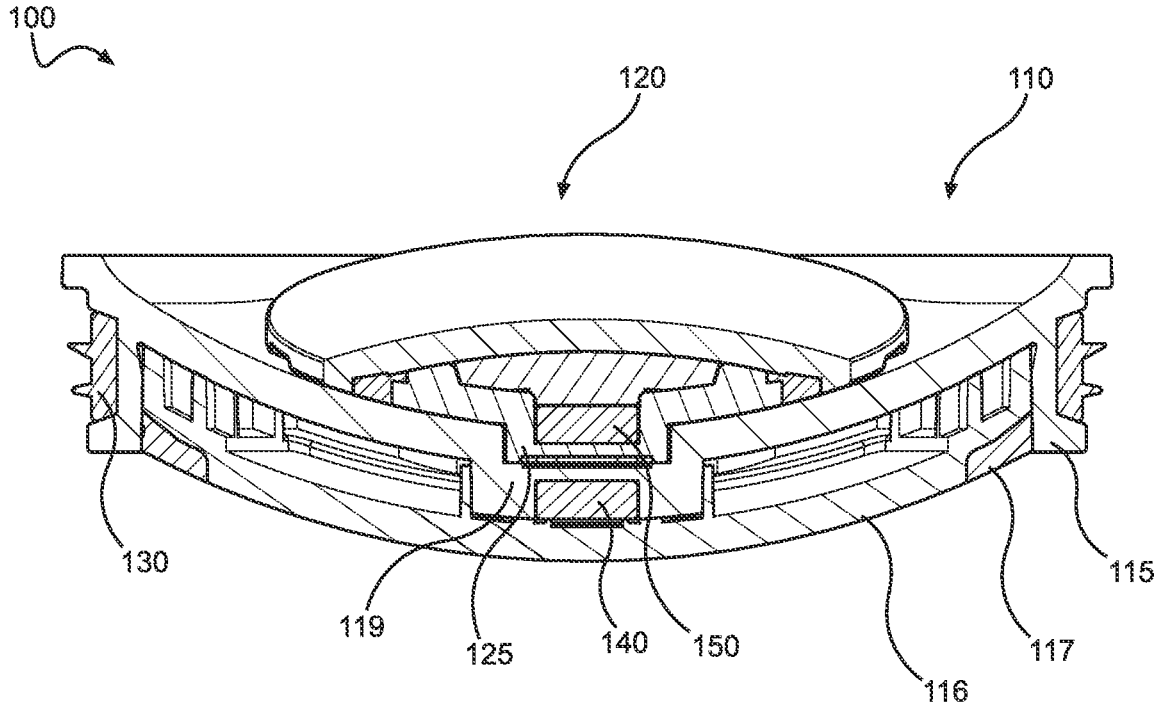
FIG. 9B illustrates in front elevation cross-section view the swivel opening lid of FIG. 9A according to one embodiment of the present disclosure.

FIGS. 8A, 8B, 9A, and 9C depict an example swivel opening lid in front elevation, side elevation cross-section, side elevation, and front elevation cross-section views respectively. The exploded cross-section view of FIG. 8B is also taken along line B-B of FIG. 8A, while the exploded cross-section view of FIG. 9B is taken along line C-C of FIG. 9A. These alternative views provide additional perspectives in showing the various parts of a fully assembled swivel opening lid 100 in a closed configuration with swiveling component 120 being rotated to a closed position such that it blocks a liquid opening 111 in stationary plate 110. In particular, these views provide relative distances and positioning for various magnetic components 140, 141, 150, 151, protrusion 125, and recess 119, among other components and features.

The foregoing illustrations of FIG. 5A through FIG. 9B depict one specific example arrangement that includes exactly two stationary magnetic components 141 that are located at stationary plate 110. The arrangement of exactly two stationary magnetic components 141 as shown can result in forming two discrete rotational positions for swiveling component 120, which discrete rotational positions can correspond to the open and closed positions shown in FIGS. 1 and 2. In other embodiments, more stationary magnetic components can be used to facilitate the formation of further discrete rotational positions. For example, four stationary magnetic components can be located within a stationary plate to result in the formation of four discrete rotational positions of a pebble or other swiveling component that correspond to the swiveling component configurations shown in FIGS. 4A-4D.

In some arrangements, swiveling component 120 may be held at or biased towards a discrete rotational position when the swiveling component is at or near that position. This can include situations where swiveling component 120 is not near a discrete rotational position, such that it is not biased or automatically pushed toward one. For example, where only two stationary magnetic components 141 are used to form only two discrete rotational positions for swiveling component 120, such as those shown as configurations 100*a* and 100*c* in FIGS. 4A and 4C, then the swiveling component can be held at those positions as well as biased or "pulled" into those positions by magnetic forces when the swiveling component gets near those positions. When the swiveling component is far enough away from those positions, however, then magnetic forces may not be strong enough to pull the swiveling component into a discrete rotational position. For example, swiveling component 120 may ordinarily rest under inertia at configurations 100*b* and 100*d* of FIGS. 4B and 4D when only two stationary magnetic components 141 are used to hold or bias the swiveling component toward configurations 100*a* or 100*c*.

Figure 10:
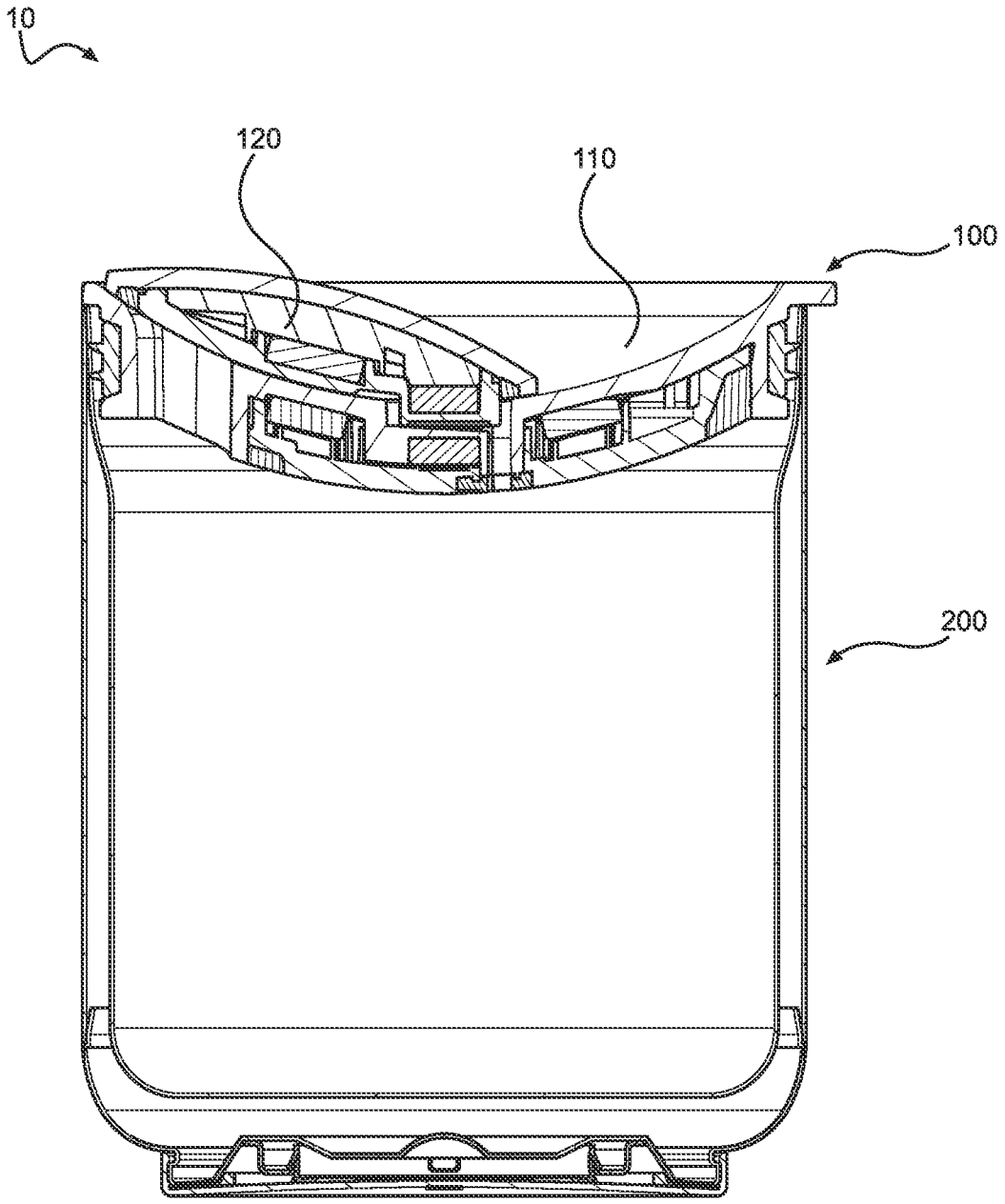
FIG. 10 illustrates in side elevation cross-section view an example liquid container with a swivel opening lid according to one embodiment of the present disclosure.

FIG. 10 illustrates in side elevation cross-section view an example liquid container with a swivel opening lid. Liquid container 10 can be identical or substantially similar to that which is shown in FIG. 1 above, and as such can include a swivel opening lid 100 and a main reservoir 200 configured to hold a beverage or other liquid therein. Swivel opening lid 100 can include a stationary plate 110 and a proximately located swiveling component 120, each with various components, parts, and features as detailed above. As noted above, main reservoir 200 can be an open top beverage container such as a cup, tumbler, water glass, wine glass, coffee mug, or the like. Swivel opening lid 100 can removably couple to main reservoir 200, and can be removed therefrom to be used with a different main reservoir in the form of a different type of beverage container or other liquid container, so long as the open top has the same dimensions.

Figure 11:
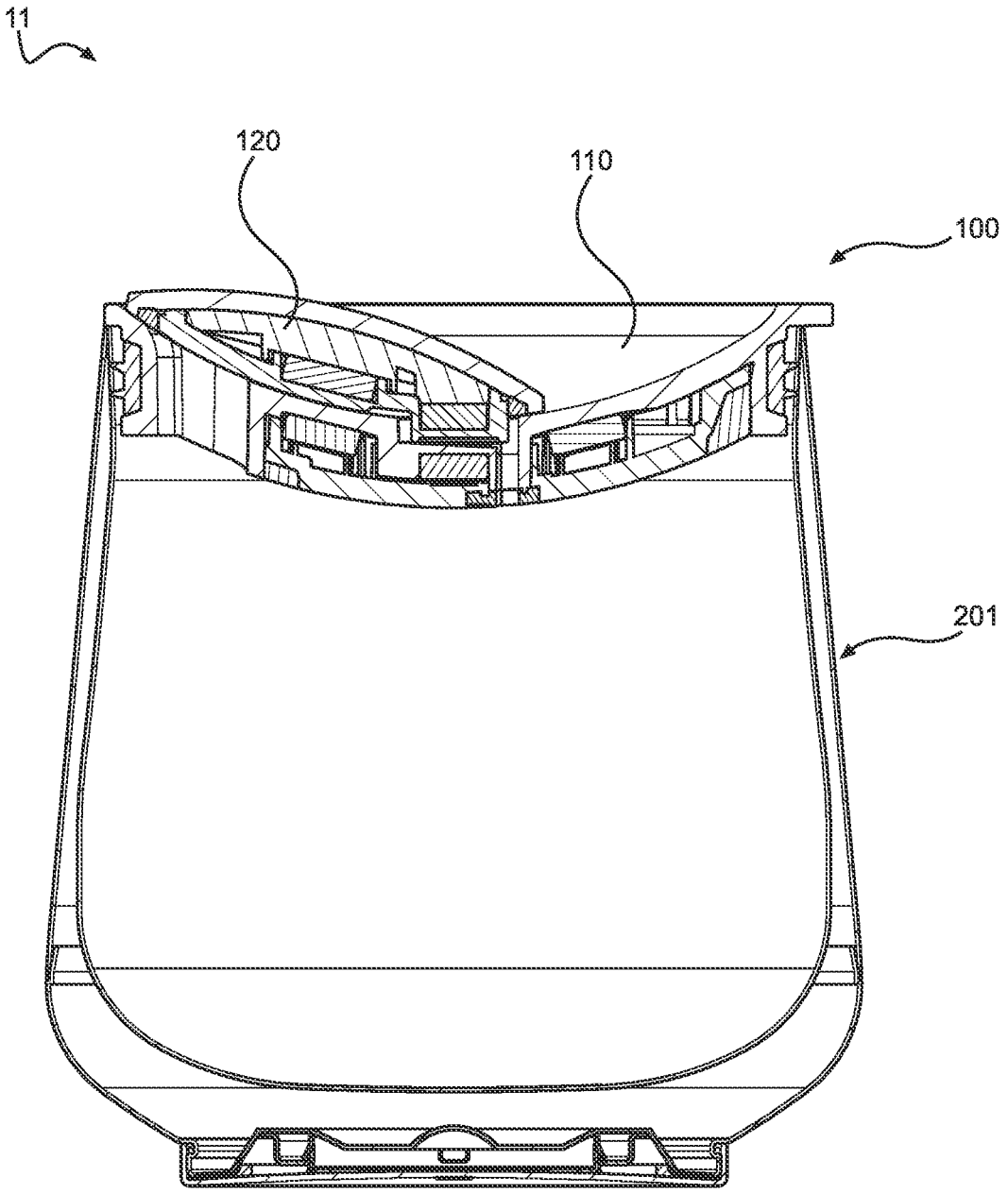
FIG. 11 illustrates in side elevation cross-section view an example alternative liquid container with a swivel opening lid according to one embodiment of the present disclosure.

Lastly, FIG. 11 illustrates in side elevation cross-section view an example alternative liquid container with a swivel opening lid. Alternative liquid container 11 can include the same swivel opening lid 100 installed to an alternative main reservoir 201 that can also be configured to hold a beverage or other liquid therein. Alternative main reservoir 201 can be a different open top beverage container such as a similar or differently shaped cup, tumbler, water glass, wine glass, coffee mug, or the like. In a particular example, alternative main reservoir can be a brandy snifter or similar drinking vessel. Again, alternative main reservoir 201 can be different from the preceding main reservoir 200 in many regards so along as the open top has the same dimensions such that it is suitable for installing the same swivel opening lid 100 thereto. Of course, a wide variety of sizes, shapes, and dimensions are possible for both swivel opening lids 100 and main reservoirs 200, such that taller, shorter, wider, and narrower variations of both items can exist.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. An apparatus, comprising:

a stationary plate having a top surface, a bottom surface, a first outer circumference, a longitudinal axis extending through the top and bottom surfaces, a recess located at the longitudinal axis, a recess magnetic component located at the recess, and a liquid opening offset from the longitudinal axis and extending through the top and bottom surfaces, wherein the stationary plate is configured to restrict the passage of liquid at its bottom surface from a separate liquid container;

a swiveling component located proximate the stationary plate and having a second outer circumference that is smaller than the first outer circumference, wherein the swiveling component is configured to rotate about the longitudinal axis relative to the stationary plate to multiple discrete rotational positions that include at least one closed position where the swiveling component blocks the liquid opening and at least one open position where the swiveling component does not block the liquid opening, the swiveling component including a protrusion offset from its center and extending into the recess such that the swiveling component rotates about the protrusion and recess, wherein the swiveling component is removably held against the stationary plate such that the swiveling component and protrusion can be readily pulled away from the stationary plate and recess with sufficient manual pulling force, and wherein the swiveling component includes a protrusion magnetic component located at the protrusion, the protrusion magnetic component and recess magnetic component being configured to generate enough attractive magnetic force between them to keep the protrusion in the recess until the sufficient manual pulling force is applied; and multiple position biasing components located at the stationary plate, the swiveling component, or both, wherein the multiple position biasing components are configured to bias the swiveling component to stop its rotation and stay at one of the discrete rotational positions.

2. The apparatus of claim 1, wherein the liquid is a beverage, the separate liquid container is a beverage container, and the apparatus is configured to be a lid for the beverage container.

3. The apparatus of claim 1, wherein the multiple discrete rotational positions include one closed position and one open position that is rotated 180 degrees from the closed position.

4. The apparatus of claim 1, wherein the multiple discrete rotational positions are about equal distances from each other.

5. The apparatus of claim 1, wherein the protrusion is coupled to the stationary plate by one or more mechanical features to keep the swiveling component and stationary plate together.

6. The apparatus of claim 1, wherein at least a portion of the multiple position biasing components are position biasing magnetic components.

7. The apparatus of claim 6, wherein the position biasing magnetic components are configured to generate enough attractive magnetic force to hold the swiveling component at any of the discrete rotational positions but not enough magnetic force to prevent manual pushing of the swiveling component away from any of the discrete rotational positions.

8. The apparatus of claim 6, wherein the position biasing magnetic components include a rotating magnetic component located at the swiveling component and a stationary magnetic component located at the stationary plate for each of the multiple discrete rotational positions, the rotating magnetic component being configured to interact with each of the stationary magnetic components separately as the rotating magnetic component rotates with the swiveling component to a discrete rotational position that corresponds to a stationary magnetic component.

9. The apparatus of claim 1, wherein at least a portion of the multiple position biasing components are embedded within and remain stationary with respect to the stationary plate, the swiveling component, or both.

10. The apparatus of claim 1, wherein the stationary plate further includes a sealing component located around its first outer circumference, the sealing component configured to form a seal against the separate liquid container when the apparatus is installed to the separate liquid container.

11. The apparatus of claim 1, further comprising:

the separate liquid container.

12. A swivel opening lid configured for use with a separate portable beverage container, the swivel opening lid comprising:

a stationary plate having a top surface, a bottom surface, a first outer circumference, a longitudinal axis extending through the top and bottom surfaces, a recess in the top surface at the longitudinal axis, and a beverage opening offset from the longitudinal axis and extending through the top and bottom surfaces, wherein the stationary plate is configured to restrict the passage of a beverage from the separate portable beverage container at its bottom surface;

a swiveling component located atop the stationary plate and having a protrusion that extends into the recess and further having a second outer circumference that is smaller than the first outer circumference, wherein the swiveling component is configured to rotate about the longitudinal axis relative to the stationary plate to multiple discrete rotational positions that include at least one closed position where the swiveling component blocks the beverage opening and at least one open position where the swiveling component does not block the beverage opening;

a recess magnetic component located at the stationary plate recess;

a protrusion magnetic component located at the swiveling component protrusion, wherein the protrusion magnetic component and recess magnetic component are configured to generate enough attractive magnetic force between them to keep the protrusion in the recess until a sufficient manual pulling force is applied to pull them apart;

a rotating magnetic component located at the swiveling component; and multiple stationary magnetic components located at the stationary plate, wherein the rotating magnetic component is configured to interact with each of the multiple stationary magnetic components separately as the rotating magnetic component rotates with the swiveling component to a discrete rotational position that corresponds to a stationary magnetic component.

13. The swivel opening lid of claim 12, wherein the rotating magnetic component is configured to interact with each of the multiple stationary magnetic components to bias the swiveling component to stop its rotation and stay at one of the discrete rotational positions.

14. The swivel opening lid of claim 12, wherein the multiple discrete rotational positions include one closed position and one open position located at 180 degrees with respect to the closed position.

15. The swivel opening lid of claim 12, further comprising:

a sealing component located around the first outer circumference of the stationary plate, wherein the sealing component is configured to facilitate the ready installation and removal of the swivel opening lid from the separate portable beverage container and is also configured to from a press-fit seal against the separate portable beverage container when the swivel opening lid is installed to the separate portable beverage container.

16. A portable beverage container, comprising:

a main reservoir configured to hold a beverage therein; and a swivel opening lid removably coupled to the main reservoir, the swivel opening lid including:

a stationary plate having a top surface, a bottom surface, a first outer circumference, a longitudinal axis extending through the top and bottom surfaces, a recess in its top surface, a recess magnetic component at the recess, and a beverage opening offset from the longitudinal axis and extending through the top and bottom surfaces, wherein the stationary plate is configured to restrict the passage of a beverage from the main reservoir at its bottom surface, a swiveling component located proximate the stationary plate and having a second outer circumference that is smaller than the first outer circumference, the swiveling component including a protrusion configured to extend into the recess and a protrusion magnetic component located at the protrusion, the protrusion magnetic component being configured to interact with the recess magnetic component to hold the swiveling component against the stationary plate, wherein the swiveling component is configured to rotate about the longitudinal axis relative to the stationary plate to multiple discrete rotational positions that include at least one closed position where the swiveling component blocks the beverage opening and at least one open position where the swiveling component does not block the beverage opening, and multiple position biasing components including multiple stationary magnetic components located at the stationary plate and a rotating magnetic component located at the swiveling component, wherein the multiple position biasing components are configured to bias the swiveling component to stop its rotation and stay at one of the discrete rotational positions by the rotating magnetic component being configured to interact with each of the multiple stationary magnetic components to hold the swiveling component at one of the discrete rotational positions.

* * * * *